US006973892B1

(12) United States Patent
Peterson

(10) Patent No.: US 6,973,892 B1
(45) Date of Patent: Dec. 13, 2005

(54) QUICK RELEASE COUPLER FOR AN INFLATABLE TOWABLE VEHICLE

(75) Inventor: Leroy L. Peterson, Omaha, NE (US)

(73) Assignee: Sportsstuff, Inc., Omaha, NE (US)

( * ) Notice: Subject to any disclaimer, the term of this patent is extended or adjusted under 35 U.S.C. 154(b) by 0 days.

(21) Appl. No.: 10/909,703

(22) Filed: Aug. 2, 2004

(51) Int. Cl.[7] ..... B63B 21/04

(52) U.S. Cl. ..... 114/253

(58) Field of Search ..... 441/66; 114/253

(56) References Cited

U.S. PATENT DOCUMENTS 3,433,503 A * 3/1969 Davis ..... 280/512
4,635,581 A * 1/1987 Scheurer ..... 114/346
5,312,128 A * 5/1994 Blacklaw ..... 280/512
5,727,806 A * 3/1998 McCoy et al. ..... 280/494
5,749,593 A * 5/1998 Phillips et al. ..... 280/476.1

* cited by examiner

*Primary Examiner*—Stephen Avila
(74) *Attorney, Agent, or Firm*—Sturm & Fix LLP

(57) ABSTRACT

The present invention provides a quick disconnect coupler for an inflatable towable vehicle including a body member attached to the towing connection of the towable vehicle and a selectively movable arm having a first end pivotally attached to the body member. The arm is movable between a closed position where the second end of the arm engages the body member and secures the towing line, and an open position where the second end pivots out of engagement with the body member and releases the towing line from the body member. A spring biased locking pin is attached to the body member and engages the second end of the arm when in the locked position. The occupant of the towable vehicle selectively pulls a T-handle or strap attached to the spring biased locking pin to pull the locking pin out of engagement with the second end of the arm and release the towing line from the body member.

8 Claims, 3 Drawing Sheets

Fig. 1
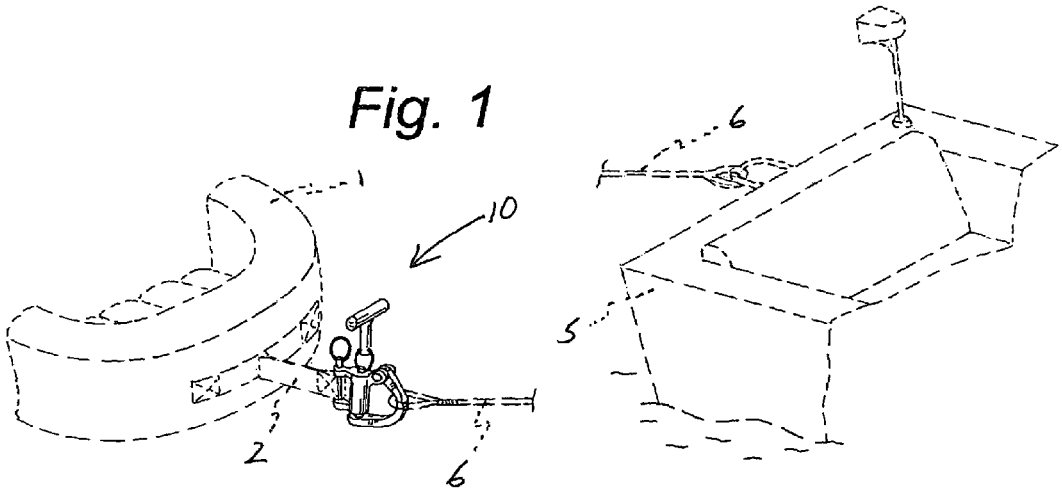
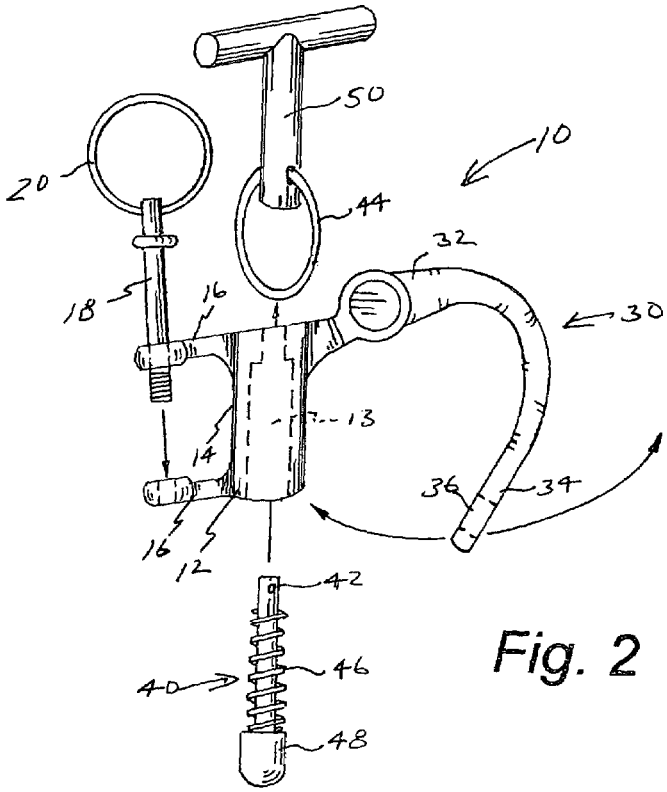
Fig. 2

QUICK RELEASE COUPLER FOR AN INFLATABLE TOWABLE VEHICLE

BACKGROUND OF THE INVENTION

1. Field of the Invention

The present invention relates to the field of tow line couplers, and more particularly to a quick disconnect coupler used in combination with an inflatable towable vehicle.

2. Description of Related Art

Inflatable towable water vehicles are towed behind powered water vehicles such as power boats, by a connecting tow line. Under certain conditions it is desirable to quickly disconnect the tow line during the towing operation. Also, at times it is desirable to give the occupant of the towable control of the disconnecting procedure.

As a consequence of the foregoing situation, there has existed a longstanding need for a new and improved quick release coupler for an inflatable towable vehicle, and the provision of such a construction is a stated objective of the present invention.

BRIEF SUMMARY OF THE INVENTION

Briefly stated, the present invention provides a quick disconnect coupler for an inflatable towable vehicle including a body member attached to the towing connection of the towable vehicle and a selectively movable arm having a first end pivotally attached to the body member. The arm is movable between a closed position where the second end of the arm engages the body member and secures the towing line, and an open position where the second end pivots out of engagement with the body member and releases the towing line from the body member. A spring biased locking pin is attached to the body member and engages the second end of the arm when in the locked position. The occupant of the towable vehicle selectively pulls a T-handle or strap attached to the spring biased locking pin to pull the locking pin out of engagement with the second end of the arm and release the towing line from the body member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view illustrating an inflatable towable vehicle and a towing water vehicle attached by a towing line secured at one end to the quick release coupler of the present invention;

FIG. 2 is an enlarged exploded perspective view of the quick release coupler;

DETAILED DESCRIPTION OF THE INVENTION

Figure 3:
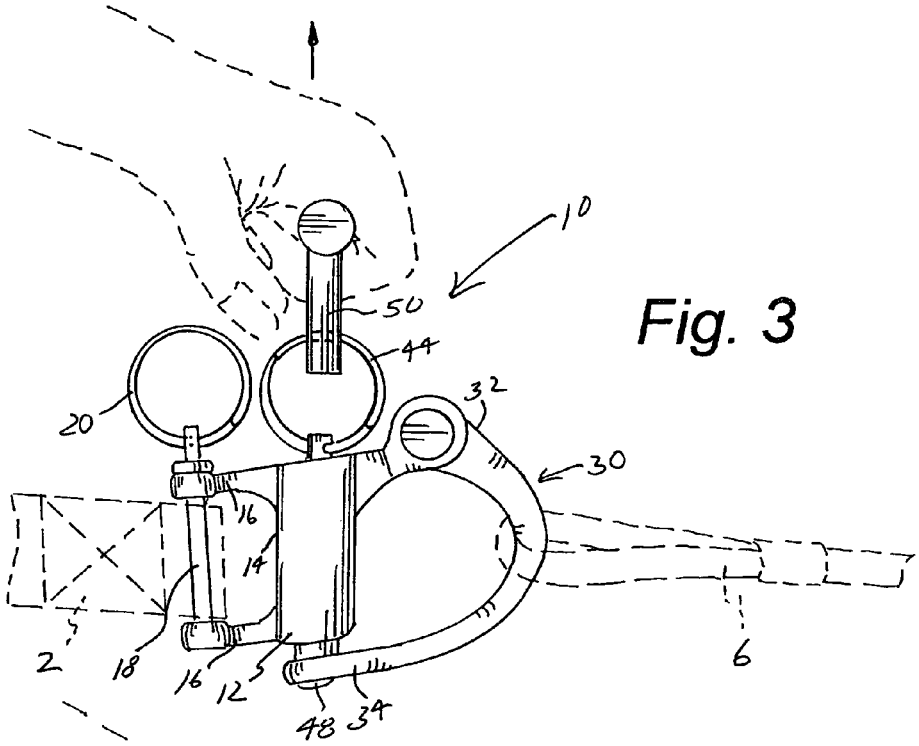
FIG. 3 is a side elevational view showing the movable arm of the coupler in the closed position securing the towing line.

As can be seen by reference to the drawings, and in particular to FIG. 1, the quick release coupler that forms the basis of the present invention is designated generally by the reference number 10. The coupler 10 is used with an inflatable towable water vehicle 1 having a towing strap 2, and a towing water vehicle or boat 5 having a connected towing line 6.

Figure 4:
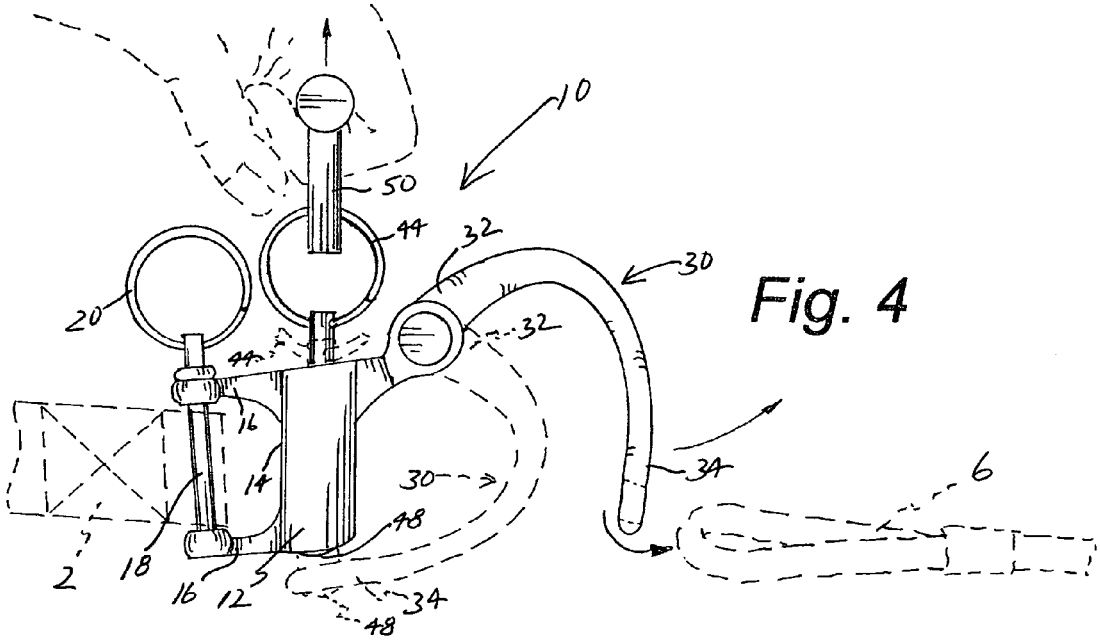
FIG. 4 is a side elevational view similar to FIG. 3, but showing the movable arm in the open position releasing the towing line.
Figure 5:
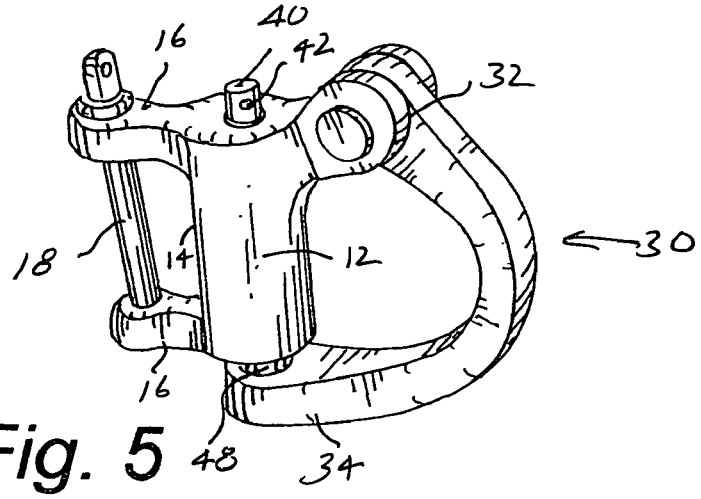
FIG. 5 is a perspective view of the coupler.
Figure 6:
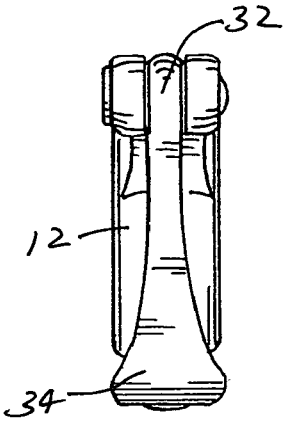
FIG. 6 is a front elevational view of the coupler.

As best shown in FIG. 4, the coupler 10 includes a body member 12 having a C-shaped portion 14 with opposing ends 16. Openings in the opposing ends 16 receive a threaded pin 18 which extends through a looped end of the towing strap 2 to secure the coupler 10 to the towable vehicle 1. A ring 20 facilitates the tightening and loosening of the pin 18 to attach and detach the coupler 10 to and from the strap 2 as desired.

A selectively movable arm 30 has a first end 32 pivotally attached at the top of the body member 12 opposite the C-shaped portion 14. A second free end 34 is releasably attachable at the bottom of the body member 12. The arm 30 is selectively movable between closed position shown in FIG. 3, and an open position shown in FIG. 4. An opening 36 in the second end 34 is disposed to receive a spring biased locking pin 40 to secure the arm 30 in the closed position.

As shown in FIG. 2, the locking pin 40 is slidably received in an opening 13 in the body member 12. The top of the pin 40 carries an opening 42 that receives the ring 44. A biasing spring 46 extends between the opening 42 and an enlarged end 48. A T-handle 50 is attached to the ring 44 to facilitate the upward movement of the pin 40 against the force of the spring 46.

Figure 7:
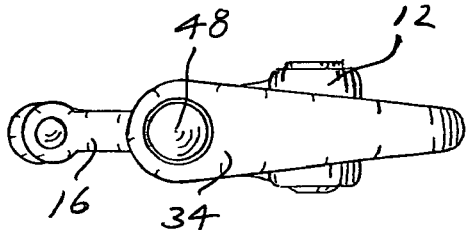
FIG. 7 is a bottom plan view of the coupler showing the smoothly tapered second end of the movable arm.

A coupler similar in appearance to the coupler 10 of the present invention is used in sailing to facilitate the release of various lines when desired. Applicant, however, is unaware of any usage of a coupler of this general style used in combination with an inflatable towable water vehicle connected by a tow line to a towing water vehicle. Also, the sailing coupler has a movable arm that has a bulbous or enlarged free end that would interfere with release of the towing line from the coupler. The movable arm 30 of the present invention has a smoothly tapered second end 34 as best shown in FIG. 7. This smoothly tapered design allows the unrestricted release of the towing line 6 from the body member 12 when the arm 30 is moved from the closed position (FIG. 3) to the open position (FIG. 4.)

In use, the coupler 10 is attached to the towing strap 2 of the inflatable towable water vehicle 1, and the towing line 6 from the towing vehicle 5 is attached to the coupler 10 as shown in FIG. 3. At any time that the occupant of the towable vehicle 1 wishes to release the towing line 6, they simply pull up on the T-handle 50 as shown in FIG. 4.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A quick disconnect coupler in combination with an inflatable towable water vehicle having a towing connection and a towing water vehicle having a towing line, the coupler comprising:

a body member attached to the towing connection of the inflatable towable water vehicle;

a selectively movable arm having a first end pivotally attached to the body member and a second end releasably attached to the body member at a point spaced from the first end, the arm being movable between a closed position wherein the second end of the arm engages the body member and secures the towing line to the body member, and an open position wherein the arm pivots out of engagement with the body member and releases the towing line from the body member and a selectively movable locking pin attached to the body member and being movable between a locked position wherein the pin is disposed to engage and secure the second end of the arm, and a released position wherein the pin is retracted from engagement with the second end of the arm.

2. The coupler of claim 1 wherein the locking pin is biased to the locked position by a spring.

3. The coupler of claim 1 wherein the second end of the arm is disposed to pivot upwardly when the locking pin is moved to the released position.

4. The coupler of claim 3 wherein the second end of the arm is smoothly tapered to allow the unrestricted release of the towing line from the body member when the arm is moved from the closed position to the open position.

5. The coupler of claim 4 wherein the towing connection of the inflatable towable water vehicle is a forwardly extending towing strap having a looped end.

6. The coupler of claim 5 wherein the body member includes a C-shaped portion having opposing ends with openings disposed to receive a threaded pin, and wherein the pin is disposed to extend through the looped end of the towing strap to attach the inflatable towable water vehicle to the body member.

7. The coupler of claim 1 wherein the second end of the arm includes an opening disposed to selectively receive the locking pin when the locking pin is in the locked position.

8. The coupler of claim 7 wherein the locking pin is biased to the locked position by a spring.

* * * * *